US009249805B2

(12) United States Patent
Stones et al.

(10) Patent No.: US 9,249,805 B2
(45) Date of Patent: Feb. 2, 2016

(54) VACUUM PUMP

(71) Applicant: Edwards Limited, Crawley, West Sussex (GB)

(72) Inventors: Ian David Stones, Burgess Hill (GB); Nigel Paul Schofield, Horsham (GB); Martin Nicholas Stuart, Shoreham-by-Sea (GB)

(73) Assignee: Edwards Limited, Crawley, West Sussex (GB)

( * ) Notice: Subject to any disclaimer, the term of this patent is extended or adjusted under 35 U.S.C. 154(b) by 0 days.

(21) Appl. No.: 14/471,698

(22) Filed: Aug. 28, 2014

(65) Prior Publication Data

US 2014/0369807 A1 Dec. 18, 2014

Related U.S. Application Data

(62) Division of application No. 10/572,894, filed as application No. PCT/GB2004/004110 on Sep. 23, 2004, now Pat. No. 8,851,865.

(30) Foreign Application Priority Data

Sep. 30, 2003 (GB) ..... 0322888.9
Apr. 23, 2004 (GB) ..... 0409139.3

(51) Int. Cl.

| | |
|---|---|
| ***F04D 19/04*** | (2006.01) |
| ***F04D 17/16*** | (2006.01) |
| ***F04D 23/00*** | (2006.01) |
| ***H01J 49/24*** | (2006.01) |

(52) U.S. Cl.

CPC ..... *F04D 19/042* (2013.01); *F04D 17/168* (2013.01); *F04D 19/044* (2013.01); *F04D 19/046* (2013.01); *F04D 23/008* (2013.01); *H01J 49/24* (2013.01)

(58) Field of Classification Search

CPC ..... F04D 19/04; F04D 19/042; F04D 19/044; F04D 19/046

See application file for complete search history.

(56) References Cited

U.S. PATENT DOCUMENTS 5,020,969 A * 6/1991 Mase et al. ..... 415/55.3
5,695,316 A 12/1997 Schutz et al.

(Continued)

FOREIGN PATENT DOCUMENTS

DE 3531942 A1 4/1986
EP 0959253 A2 11/1999

(Continued)

OTHER PUBLICATIONS

Prosecution history of corresponding U.S. Appl. No. 10/572,894, filed Mar. 20, 2006 including: Notice of Allowance dated May 29, 2014; Notice of Allowance dated Mar. 20, 2014; Examiner's Answer dated May 13, 2011; Appeal Brief dated Mar. 2, 2011; Final Rejection dated Jun. 10, 2010; Amendment dated Jan. 21, 2010; Office Action dated Jun. 13, 2008 and Preliminary Amendment dated Mar. 20, 2006.

(Continued)

*Primary Examiner* — Nathan J Newhouse
*Assistant Examiner* — Christopher Bobish
(74) *Attorney, Agent, or Firm* — Westman, Champlin & Koehler, P.A.

(57) ABSTRACT

A vacuum pump comprises a molecular drag pumping mechanism and a regenerative pumping mechanism. A rotor element of the molecular drag pumping mechanism surrounds rotor elements of the regenerative pumping mechanism.

19 Claims, 5 Drawing Sheets

(56) References Cited

U.S. PATENT DOCUMENTS

| | | | | |
|---|---|---|---|---|
| 5,733,104 | A | 3/1998 | Conrad et al. | |
| 6,599,084 | B1 * | 7/2003 | Schutz et al. | 415/90 |
| 6,793,466 | B2 | 9/2004 | Miyamoto | |
| 2002/0122729 | A1 | 9/2002 | Yamashita et al. | |
| 2003/0170132 | A1 | 9/2003 | Englander et al. | |

FOREIGN PATENT DOCUMENTS

| | | | | |
|---|---|---|---|---|
| EP | 959253 | A2 * | 11/1999 | F04D 19/04 |
| EP | 1302667 | A1 | 4/2003 | |
| FR | 2262742 | A1 | 9/1975 | |
| JP | H02136595 | A | 5/1990 | |
| JP | H02264196 | A | 10/1990 | |
| JP | H06280785 | A | 10/1994 | |
| JP | H08511071 | A | 11/1996 | |
| JP | H11351190 | A | 12/1999 | |
| JP | 2002285987 | A | 10/2002 | |
| WO | 2005033520 | A1 | 4/2005 | |

OTHER PUBLICATIONS

Prosecution history of corresponding Canadian Application No. 2,563,234 including: Office Action dated Nov. 18, 2010 and Response dated Dec. 15, 2010.

Prosecution history of corresponding Chinese Application No. 200480028403.1 including: First Office Action dated Dec. 28, 2007; Response dated Apr. 15, 2008; Response dated Mar. 18, 2009; Notification for Reexamination dated Oct. 18, 2010; Response dated Nov. 24, 2010; Notification of Reexamination dated Jul. 7, 2011; Response dated Jan. 30, 2011; Fourth Office Action dated Jan. 11, 2012 and Response dated Mar. 14, 2012.

Prosecution history of corresponding Chinese Application No. 201110048747.0 including: First Office Action dated Jul. 21, 2011 and Response dated Jan. 31, 2013.

Prosecution history of corresponding European Application No. 04768653.0-1267 including: Response dated Apr. 22, 2009; Communication dated Dec. 15, 2010 and Response dated Apr. 21, 2011.

Prosecution history of corresponding Japanese Application No. 2006530557 including: Reason for Rejection dated Mar. 29, 2010 and Response dated Jun. 22, 2010.

Prosecution history of corresponding Japanese Application No. 2011089466 including: Reason for Rejection dated Apr. 15, 2013 and Response dated Jul. 4, 2013.

United Kingdom Search Reports dated Jun. 18, 2004 and Jun. 21, 2004 for corresponding British Application No. GB0322888.9.

PCT International Search Report and Written Opinion dated Jan. 17, 2005 for corresponding PCT Application No. PCT/GB2004/004110.

* cited by examiner

VACUUM PUMP

The present application is a divisional of and claim priority of U.S. patent application Ser. No. 10/572,894, filed Mar. 20, 2006, which is a Section 371 National Stage of and claims priority of International patent application No. PCT/GB04/004110, filed Sep. 23, 2004, the content of which is hereby incorporated by reference in its entirety and published as WO 2005/033520 on Apr. 14, 2005 and which claims priority of British Application No. 0409139.3, filed Apr. 23, 2004 and British Application No. 0322888.9, filed Sep. 30, 2003.

FIELD OF THE INVENTION

This invention relates to a vacuum pump and in particular a compound vacuum pump.

BACKGROUND OF THE INVENTION

In a differentially pumped mass spectrometer system a sample and carrier gas are introduced to a mass analyser for analysis. One such example is given in FIG. 1. With reference to FIG. 1, in such a system there exists a high vacuum chamber 10 immediately following first, (depending on the type of system) second, and third evacuated interface chambers 11, 12, 14. The first interface chamber is the highest-pressure chamber in the evacuated spectrometer system and may contain an orifice or capillary through which ions are drawn from the ion source into the first interface chamber 11. The second, optional interface chamber 12 may include ion optics for guiding ions from the first interface chamber 11 into the third interface chamber 14, and the third chamber 14 may include additional ion optics for guiding ions from the second interface chamber into the high vacuum chamber 10. In this example, in use, the first interface chamber is at a pressure of around 1-10 mbar, the second interface chamber (where used) is at a pressure of around $10^{-1}$-1 mbar, the third interface chamber is at a pressure of around $10^{-2}$-$10^{-3}$ mbar, and the high vacuum chamber is at a pressure of around $10^{-5}$-$10^{-6}$ mbar.

The high vacuum chamber 10, second interface chamber 12 and third interface chamber 14 can be evacuated by means of a compound vacuum pump 16. In this example, the vacuum pump has two pumping sections in the form of two sets 18, 20 of turbo-molecular stages, and a third pumping section in the form of a Holweck drag mechanism 22; an alternative form of drag mechanism, such as a Siegbahn or Gaede mechanism, could be used instead. Each set 18, 20 of turbo-molecular stages comprises a number (three shown in FIG. 1, although any suitable number could be provided) of rotor 19*a*, 21*a* and stator 19*b*, 21*b* blade pairs of known angled construction. The Holweck mechanism 22 includes a number (two shown in FIG. 1 although any suitable number could be provided) of rotating cylinders 23*a* and corresponding annular stators 23*b* and helical channels in a manner known per se.

In this example, a first pump inlet 24 is connected to the high vacuum chamber 10, and fluid pumped through the inlet 24 passes through both sets 18, 20 of turbo-molecular stages in sequence and the Holweck mechanism 22 and exits the pump via outlet 30. A second pump inlet 26 is connected to the third interface chamber 14, and fluid pumped through the inlet 26 passes through set 20 of turbo-molecular stages and the Holweck mechanism 22 and exits the pump via outlet 30. In this example, the pump 16 also includes a third inlet 27 which can be selectively opened and closed and can, for example, make the use of an internal baffle to guide fluid into the pump 16 from the second, optional interface chamber 12.

With the third inlet open, fluid pumped through the third inlet 27 passes through the Holweck mechanism only and exits the pump via outlet 30.

In this example, in order to minimise the number of pumps required to evacuate the spectrometer, the first interface chamber 11 is connected via a foreline 31 to a backing pump 32, which also pumps fluid from the outlet 30 of the compound vacuum pump 16. The backing pump typically pumps a larger mass flow directly from the first chamber 11 than that from the outlet 30 of the compound vacuum pump 16. As fluid entering each pump inlet passes through a respective different number of stages before exiting from the pump, the pump 16 is able to provide the required vacuum levels in the chambers 10, 12, 14, with the backing pump 32 providing the required vacuum level in the chamber 11.

The performance and power consumption of the compound pump 16 is dependent largely upon its backing pressure, and is therefore dependent upon the foreline pressure (and the pressure in the first interface chamber 11) offered by the backing pump 32. This in itself is dependent mainly upon two factors, namely the mass flow rate entering the foreline 31 from the spectrometer and the pumping capacity of the backing pump 32. Many compound pumps having a combination of turbo-molecular and molecular drag stages are only ideally suited to low backing pressures, and so if the pressure in the foreline 31 (and hence in the first interface chamber 11) increases as a result of increased mass flow rate or a smaller backing pump size, the resulting deterioration in performance and increase in power consumption can be rapid. In an effort to increase mass spectrometer performance, manufactures often increase the mass flow rate into the spectrometer. Increasing the size or number of backing pumps to accommodate for the increased mass flow rate increases both costs and the size of the overall pumping system required to differentially evacuate the mass spectrometer.

In at least its preferred embodiments, the present invention seeks to provide a compound vacuum pump that can operate more efficiently at higher backing pressures.

SUMMARY OF THE INVENTION

In a first aspect, the present invention provides a vacuum pump comprising a molecular drag pumping mechanism and, downstream therefrom, a regenerative pumping mechanism, wherein a rotor element of the molecular drag pumping mechanism surrounds rotor elements of the regenerative pumping mechanism.

The pump thus incorporates a downstream regenerative pumping mechanism in addition to a molecular drag pumping mechanism. The regenerative pumping mechanism compresses gas pumped by the molecular drag pumping mechanism and so delivers a backing pressure to the molecular drag pumping mechanism which can be lower than the foreline to which the pump is attached, thereby reducing the power consumption of the molecular drag pumping mechanism and improving the performance of the pump (whilst the regenerative pumping mechanism will itself consume power, for high backing pressures this increased power consumption is less than the power that would be consumed if the molecular drag pumping mechanism were exposed directly to the foreline).

Whilst providing a regenerative pumping mechanism downstream from a molecular drag pumping mechanism address the problems relating to pump performance and power consumption, it is also important to address these problems with minimum impact on the size of the pump. By arranging the pumping mechanism such that a rotor element of the molecular drag pumping mechanism surrounds rotor elements of the regenerative pumping mechanism, lower power consumption and improved pump performance can be provided with no, or little, increase in pump size.

The rotor element of the molecular drag pumping mechanism preferably comprises a cylinder mounted for rotary movement with the rotor elements of the regenerative pumping mechanism. This cylinder preferably forms part of a multi-stage Holweck pumping mechanism. Whilst in the preferred embodiments the pump comprises a two stage Holweck pumping mechanism, additional stages may be provided by increasing the number of cylinders and corresponding stator elements accordingly. The additional cylinder(s) can be mounted on the same impeller disc at a different diameter in a concentric manner such that the axial positions of the cylinders are approximately the same.

The rotor element of the molecular drag pumping mechanism and the rotor elements of the regenerative pumping mechanism may be conveniently located on a common rotor of the pump. This rotor is preferably integral with an impeller mounted on the drive shaft of the pump, and may be provided by a disc substantially orthogonal to the drive shaft. The rotor elements of the regenerative pumping mechanism may comprise a series of blades positioned in an annular array on one side of the rotor. These blades are preferably integral with the rotor. With this arrangement of blades, the rotor element of the molecular drag pumping mechanism can be conveniently mounted on the same side of the rotor.

The regenerative pumping mechanism may comprise more than one stage, and so include at least two series of blades positioned in concentric annular arrays on said one said of the rotor such that the axial positions of the blades are approximately the same.

To assist in minimising the size of the pump, a common stator may be provided for the regenerative pumping mechanism and at least part of the molecular drag pumping mechanism. In a second aspect, the present invention provides a vacuum pump comprising a molecular drag pumping mechanism and a regenerative pumping mechanism, a drive shaft having located thereon a rotor element for the molecular drag pumping mechanism and rotor elements for the regenerative pumping mechanism, and a common stator for both the regenerative pumping mechanism and at least part of the molecular drag pumping mechanism.

The pump may further comprise a Gaede pumping mechanism, with the rotor element of the molecular drag pumping mechanism surrounding the rotor elements of the Gaede pumping mechanism.

An additional pumping mechanism may be provided upstream from the molecular drag stage. In the preferred embodiments, this additional pumping mechanism comprises at least one turbomolecular pumping stage. A rotor element of the additional pumping mechanism may be conveniently located on, preferably integral with, the impeller mounted on the drive shaft.

A pump inlet is preferably located upstream from the additional pumping mechanism, with the pump outlet located downstream from the regenerative pumping mechanism. A second pump inlet is preferably located between the additional pumping mechanism and the regenerative pumping mechanism. In one example, this second pump inlet is located between the additional pumping mechanism and the molecular drag pumping mechanism. Alternatively, the second pump inlet may be located between at least part of the molecular drag pumping mechanism and the regenerative pumping mechanism. This second inlet may be positioned such that fluid entering the pump therethrough follows a different path through the molecular drag pumping mechanism than fluid entering the pump through the first pump inlet, or such that fluid entering the pump therethrough follows only part of the path through the molecular drag pumping mechanism of fluid entering the pump through the first pump inlet. In this case, a third pump inlet may be located between the additional pumping mechanism and the molecular drag pumping mechanism.

A further turbomolecular pumping mechanism may be provided upstream from the additional pumping mechanism. A rotor element of the turbomolecular pumping mechanism can be conveniently located on, preferably integral with, the impeller mounted on the drive shaft. Another pump inlet may be located upstream from the turbomolecular pumping mechanism.

In use, the pressure of fluid exhaust from the pump is preferably equal to or greater than 1 mbar.

In another aspect, the present invention provides an impeller for a vacuum pump, the impeller comprising a rotor element of a molecular drag pumping mechanism and a plurality of rotor elements of a regenerative pumping mechanism, wherein the rotor element of the molecular drag pumping mechanism surrounds the rotor elements of the regenerative pumping mechanism. The invention also extends to a pump incorporating such an impeller.

In a further aspect, the present invention provides an impeller for a vacuum pump, the impeller having integral therewith at least one rotor element of a turbomolecular pumping stage, a plurality of rotor elements of a regenerative pumping mechanism, and a rotor for receiving at least one rotor element of a molecular drag pumping mechanism.

BRIEF DESCRIPTION OF THE DRAWINGS

Preferred features of the present invention will now be described, by way of example only, with reference to the accompanying drawings, in which.

DETAILED DESCRIPTION OF THE INVENTION

Figure 2:
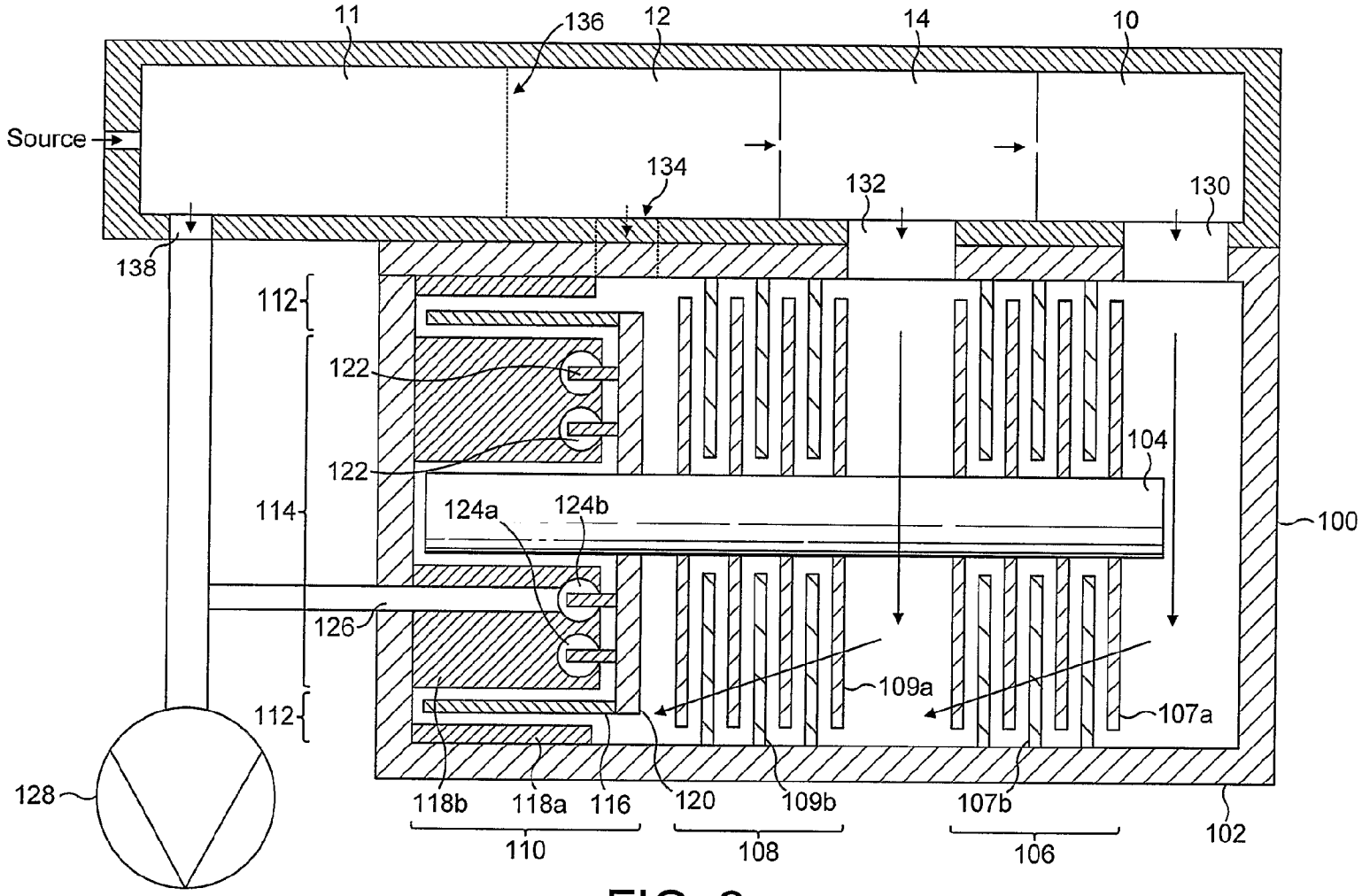
FIG. 2 is a simplified cross-section through a first embodiment of a multi port vacuum pump suitable for evacuating the differentially pumped mass spectrometer system of FIG. 1.

FIG. 2 illustrates a first embodiment of a compound multi port vacuum pump 100. The pump comprises a multi-component body 102 within which is mounted a drive shaft 104. Rotation of the shaft is effected by a motor (not shown), for example, a brushless dc motor, positioned about the shaft 104. The shaft 104 is mounted on opposite bearings (not shown). For example, the drive shaft 104 may be supported by a hybrid permanent magnet bearing and oil lubricated bearing system.

The pump includes at least three pumping sections 106, 108, 110. The first pumping section 106 comprises a set of turbo-molecular stages. In the embodiment shown in FIG. 2, the set of turbo-molecular stages 106 comprises four rotor blades and three stator blades of known angled construction.

A rotor blade is indicated at 107*a* and a stator blade is indicated at 107*b*. In this example, the rotor blades 107*a* are mounted on the drive shaft 104.

The second pumping section 108 is similar to the first pumping section 106, and also comprises a set of turbo-molecular stages. In the embodiment shown in FIG. 2, the set of turbo-molecular stages 108 also comprises four rotor blades and three stator blades of known angled construction. A rotor blade is indicated at 109*a* and a stator blade is indicated at 109*b*. In this example, the rotor blades 109*a* are also mounted on the drive shaft 104.

Downstream of the first and second pumping sections is a third pumping section 110. In the embodiment shown in FIG. 2, the third pumping section comprises a molecular drag pumping mechanism 112 and a regenerative pumping mechanism 114.

The molecular drag mechanism 112 is in the form of a Holweck drag mechanism. In this embodiment, the Holweck mechanism comprises a rotating cylinder 116 and corresponding annular stators 118*a*, 118*b* having helical channels formed therein in a manner known per se. In this embodiment, the Holweck mechanism comprises two pumping stages, although any number of stages may be provided depending on pressure, flow rate and capacity requirements. The rotating cylinder 116 is preferably formed from a carbon fibre material, and is mounted on a rotor element 120, preferably in the form of a disc 120, which is located on the drive shaft 104. In this example, the disc 120 is also mounted on the drive shaft 104.

The regenerative pumping mechanism 114 comprises a plurality of rotors in the form of at least one annular array of blades 122 mounted on, or integral with, one side of the disc 120 of the Holweck mechanism 112. In the embodiment, the regenerative pumping mechanism 114 comprises two concentric annular arrays of rotors 122, although any number of annular arrays may be provided depending on pressure, flow rate and capacity requirements.

Stator 118*b* of the molecular drag pumping mechanism 112 can also form the stator of the regenerative pumping mechanism 114, and has formed therein annular channels 124*a*, 124*b* within which the rotors 122 rotate. As is known, the channels 124*a*, 124*b* have a cross sectional area greater than that of the individual blades 122, except for a small part of the channel known as a "stripper" which has a reduced cross section providing a close clearance for the rotors. In use, pumped fluid pumped enters the outermost annular channel 124*a* via an inlet positioned adjacent one end of the stripper and the fluid is urged by means of the rotors 122 along the channel 124*a* until it strikes the other end of the stripper. The fluid is then urged through a port into the innermost annular channel 124*b*, where it is urged along the channel 124 to the outlet 126.

Downstream of the regenerative pumping mechanism 114 is a pump outlet 126. A backing pump 128 backs the pump 100 via outlet 126.

As illustrated in FIG. 2, the pump 100 has two inlets 130, 132; although only two inlets are used in this embodiment, the pump may have an additional, optional inlet indicated at 134, which can be selectively opened and closed and can, for example, make the use of internal baffles to guide different flow streams to particular portions of a mechanism. The inlet 130 is located upstream of all of the pumping sections. The inlet 132 is located interstage the first pumping section 106 and the second pumping section 108. The optional inlet 134 is located interstage the second pumping section 108 and the third pumping section 110, such that all of the stages of the molecular drag pumping mechanism 112 are in fluid communication with the optional inlet 134.

Figure 1:
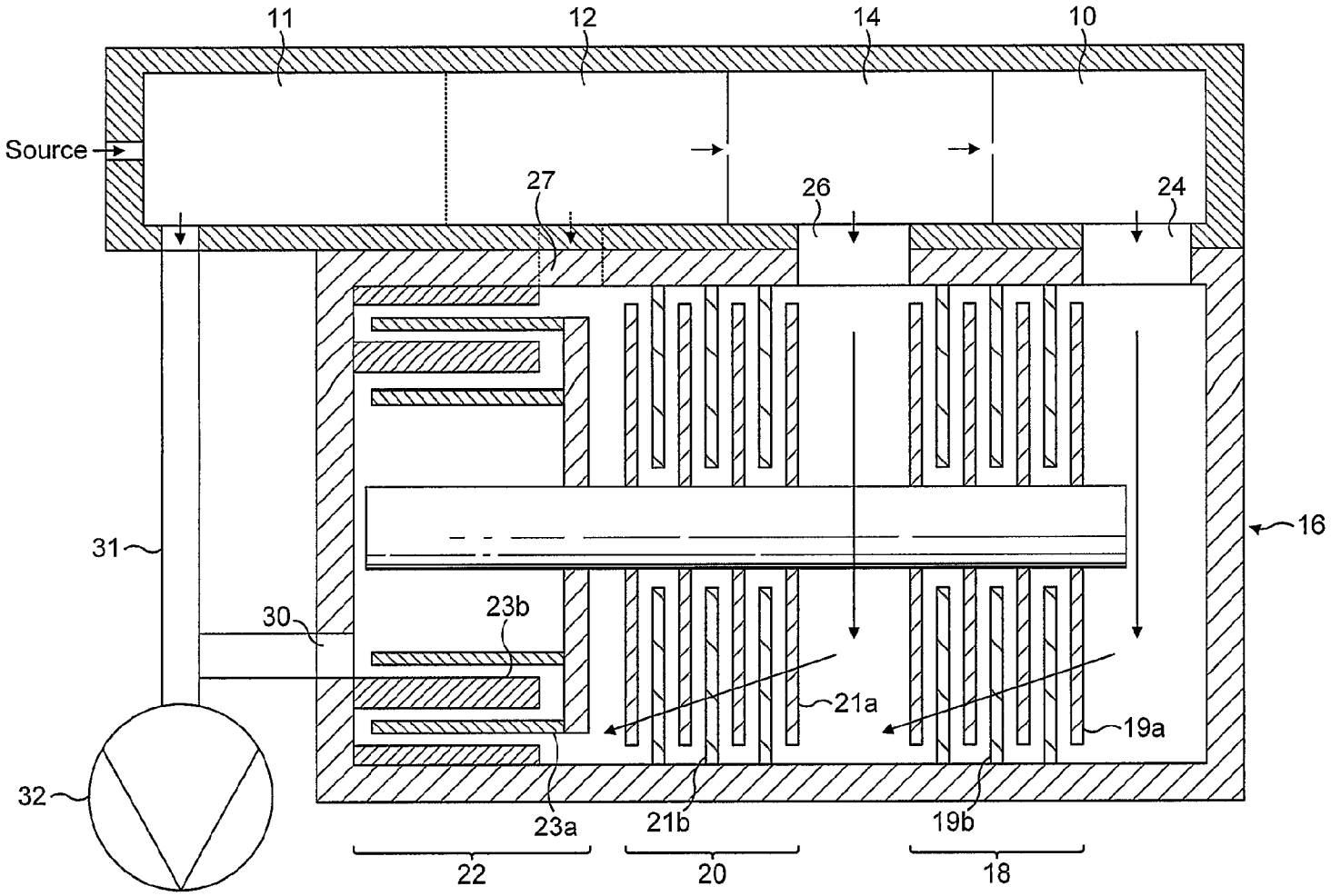
FIG. 1 (PRIOR ART)
FIG. 1 is a simplified cross-section through a known multi port vacuum pump suitable for evacuating a differentially pumped, mass spectrometer system.

In use, each inlet is connected to a respective chamber of the differentially pumped vacuum system, in this embodiment the same mass spectrometer system as illustrated in FIG. 1. Thus, inlet 130 is connected to a low pressure chamber 10, and inlet 132 is connected to a middle pressure chamber 14. Where another chamber 12 is present between the high pressure chamber 11 and the middle pressure chamber 14, as indicated by the dotted line 136, the optional inlet 134 is opened and connected to this chamber 12. Additional lower pressure chambers may be added to the system, and may be pumped by separate means. The high pressure interface chamber 11 is connected via a foreline 138 to the backing pump 128, which also pumps fluid from the outlet 126 of the compound vacuum pump 100.

In use, fluid passing through inlet 130 from the low pressure chamber 10 passes through the first pumping section 106, the second pumping section 108 and the third pumping section 110, and exits the pump 100 via pump outlet 126. Fluid passing through inlet 122 from the middle pressure chamber 14 enters the pump 100, passes through the second pumping section 108 and the third pumping section 110, and exits the pump 100 via pump outlet 126. If opened, fluid passing through the optional inlet 124 from chamber 12 enters the pump 100, passes through the third pumping section 110 only and exits the pump 100 via pump outlet 126.

In this example, in use, and similar to the system described with reference to FIG. 1, the first interface chamber 11 is at a pressure around 1-10 mbar, the second interface chamber 12 (where used) is at a pressure of around $10^{-1}$-1 mbar, the third interface chamber 14 is at a pressure of around $10^{-2}$-$10^{-3}$ mbar, and the high vacuum chamber 10 is at a pressure of around $10^{-5}$-$10^{-6}$ mbar. However, due the compression of the gas passing through the pump by the regenerative pumping mechanism 112, the regenerative pumping mechanism can serve to deliver a backing pressure to the molecular drag pumping stage 110 which is lower than the pressure in the foreline 138. This can significantly reduce the power consumption of the pump 100 and improve pump performance.

Furthermore, as indicated in FIG. 2, the rotors 1 22 of the regenerative pumping mechanism 114 are surrounded by the rotating cylinder 116 of the molecular drag pumping mechanism 112. Thus, the regenerative pumping mechanism 114 can be conveniently included in the vacuum pump 100 of the first embodiment with little, or no, increase in the overall length or size of the vacuum pump.

Figure 3:
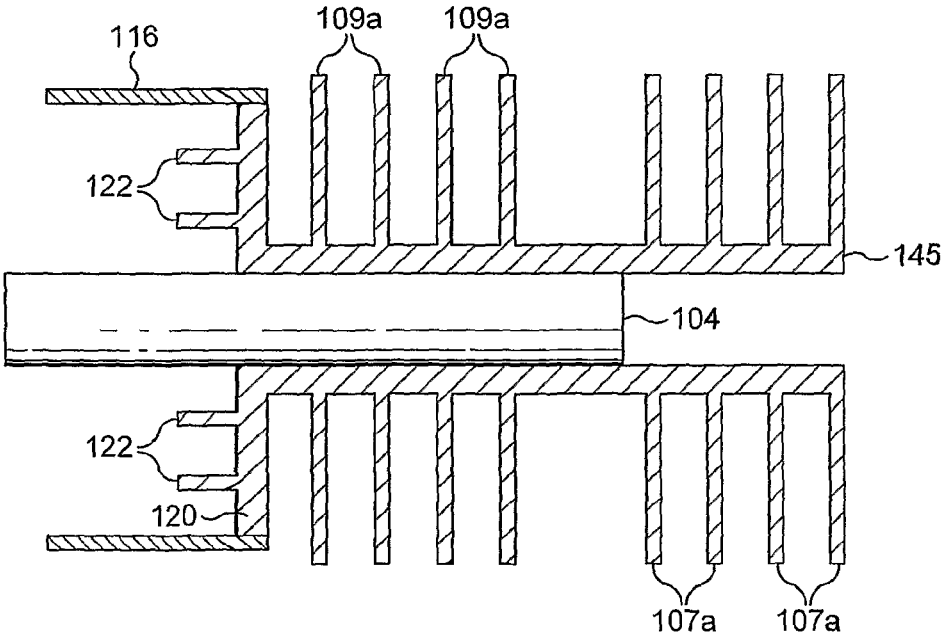
FIG. 3 is a simplified cross-section through the impeller suitable for use in the pump shown in FIG. 2.

As illustrated in FIG. 3, in this embodiment, rotors 107, 109, of the turbo-molecular sections 106, 108, the rotating disc 120 of the molecular drag mechanism 112 and the rotors 122 of the regenerative pumping mechanism 114 may be located on a common impeller 145, which is mounted on the drive shaft 104, with the carbon fibre rotating cylinder 116 of the molecular drag pumping mechanism 112 being mounted on the rotating disc 120 following machining of these integral rotary elements. However, only one or more of these rotary elements may be integral with the impeller 145, with the remaining elements being mounted on the drive shaft 104 as in FIG. 2, or located on another impeller, as required. The right (as shown) end of the impeller 145 may be supported by a magnetic bearing, with permanent magnets of this bearing being located on the impeller, and the left (as shown) end of the drive shaft 104 may be supported by a lubricated bearing.

Figure 4:
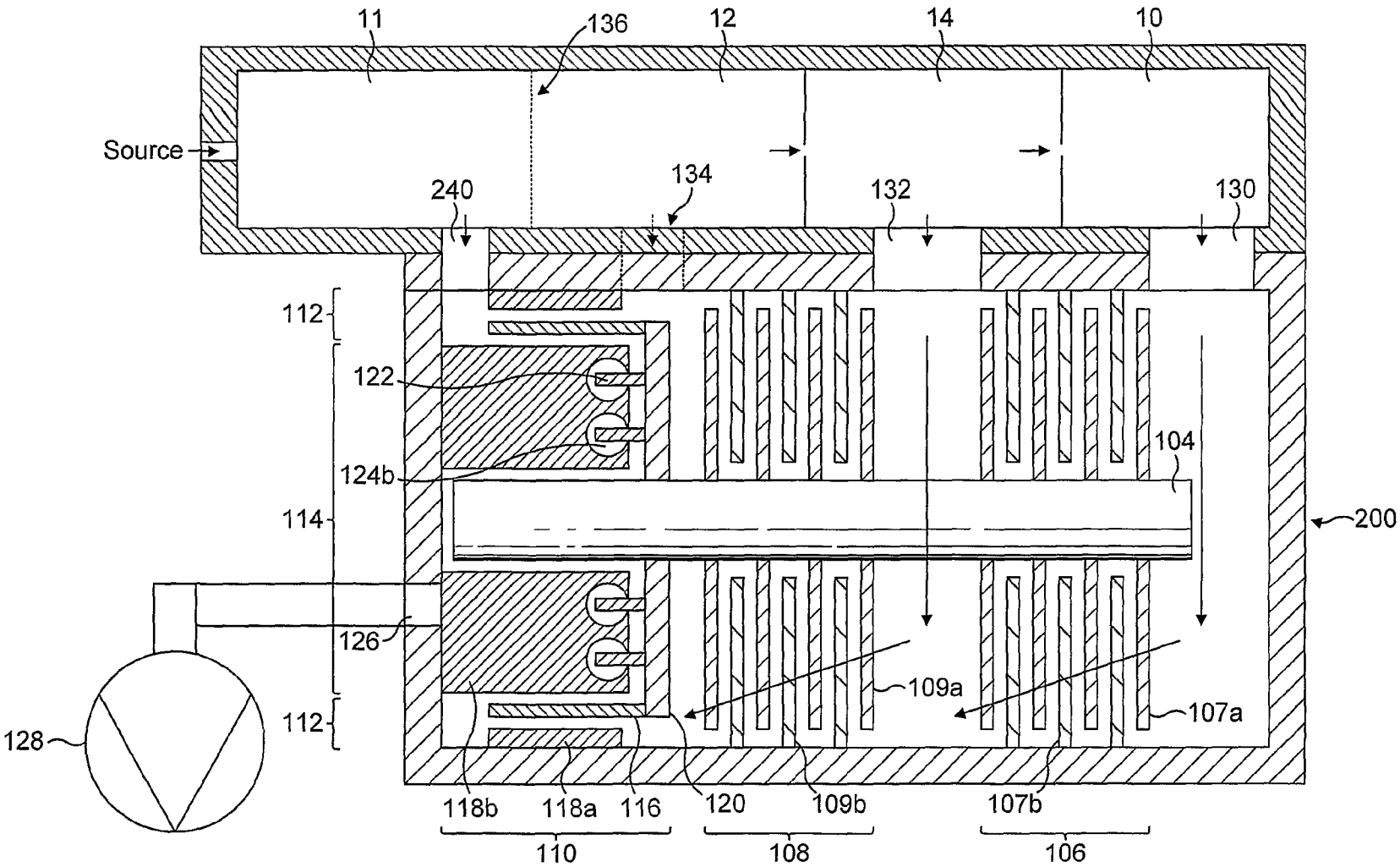
FIG. 4 is a simplified cross-section through a second embodiment of a multi port vacuum pump suitable for evacuating the differentially pumped mass spectrometer system of FIG. 1.

FIG. 4 illustrates a second embodiment of a compound multi port vacuum pump 200, which differs from the first embodiment in that it is suitable for evacuating more than 99% of the total mass flow in the differentially pumped mass spectrometer system described above with reference to FIG. 1. This is achieved by the vacuum pump 200 being arranged so as to be able to pump directly the highest pressure chamber, in addition to the usual second and third highest pressure chambers. As well as the inlets 130, 132 and optional inlet 134, the pump 200 contains an additional inlet 240 located upstream of or, as illustrated in FIG. 4, between the stages of the molecular drag pumping mechanism 112, such that all of the stages of the molecular drag pumping mechanism 112 are in fluid communication with the inlets 130, 132, whilst, in the arrangement illustrated in FIG. 4, only a portion (one or more) of the stages are in fluid communication with the additional inlet 240.

In use, inlet 130 is connected to a low pressure chamber 10, inlet 132 is connected to a middle pressure chamber 14 and the additional inlet 240 is connected to the highest pressure chamber 11. Where a fourth chamber 12 is present between the high pressure chamber 11 and the middle pressure chamber 14, as indicated by the dotted line 136, the optional inlet 134 is opened and connected to the fourth chamber 12. Additional lower pressure chambers may be added to the system, and may be pumped by separate means, however, the mass flow of these additional chambers is typically much less than 1% of the total mass flow of the spectrometer system.

In use, the vacuum pump 200 can generate a similar performance advantage in the chambers of the differentially pumped mass spectrometer system as the vacuum pump 100 of the first embodiment. In addition to the potential performance advantage offered by the first embodiment, this second embodiment can also offer a number of other advantages. The first of these is that, by enabling the high pressure chamber of the differentially pumped mass spectrometer system to be directly pumped by the same compound multi port vacuum pump 200 that pumps the second and third highest pressure chambers, rather than by the backing pump 128, the compound multi port vacuum pump is able to manage more than 99% of the total fluid mass flow of the mass spectrometer system. Thus, the performance of the high pressure chamber 11 and the rest of the internally linked spectrometer system can be increased without increasing the size of the backing pump.

The second of these is the consistency of the system performance and power when backed by pumps with different levels of performance, for example a backing pump operating directly on line at 50 or 60 Hz. In the case of this second embodiment it is anticipated that, in the system described with reference to FIG. 4, the variation in system performance will be as low as 1% if the frequency of operation of the backing pump 128 is varied between 50 Hz and 60 Hz, thus providing the user with a flexible pumping arrangement with stable system performance and power. (It should be noted that, depending on the design of the mass spectrometer, this advantage could also be afforded, albeit to a lesser degree, by the first embodiment. "Free jet expansion" is sometimes applied to mass spectrometer systems, with the result that the pressure of the first chamber has very little effect on the pressure of the subsequent chambers. Thus the only factor having a strong influence on the performance of the lower pressure chambers is the compound pump itself. The regenerative pumping mechanism ensures that the performance is stabilised better when changes occur to the backing pressure, as they maintain the pump performance to a higher backing pressure. Even at low pressures the regenerative pumping mechanism will serve to 'restrict' the backing performance thus again providing a more constant backing to the remainder of the pump).

Another advantage of the second embodiment is that, as the backing pump 128 no longer draws fluid directly from the high pressure chamber 11, the capacity, and thus the size, of the backing pump 128 can be significantly reduced in comparison to the first embodiment. (Again, it should be noted that where "free jet expansion" is used, a similar advantage may be afforded, albeit to a lesser degree, by the first embodiment). This is because, by virtue of the regenerative pumping mechanism 114, the vacuum pump 200 can exhaust fluid at a pressure of above 10 mbar. In contrast, the vacuum pump 100 of the prior art described in FIG. 1 typically exhausts fluid at a pressure of around 1-10 mbar, and so the size of the backing pump can be reduced significantly in this second embodiment. It is anticipated that this size reduction could be as much as a factor of 10 in some mass spectrometer systems without adversely affecting system performance. Thus, the whole pumping system of the second embodiment, including both vacuum pump 200 and backing pump 128, could be reduced in size and possibly conveniently housed within a bench-top mounted enclosure.

Figure 5:
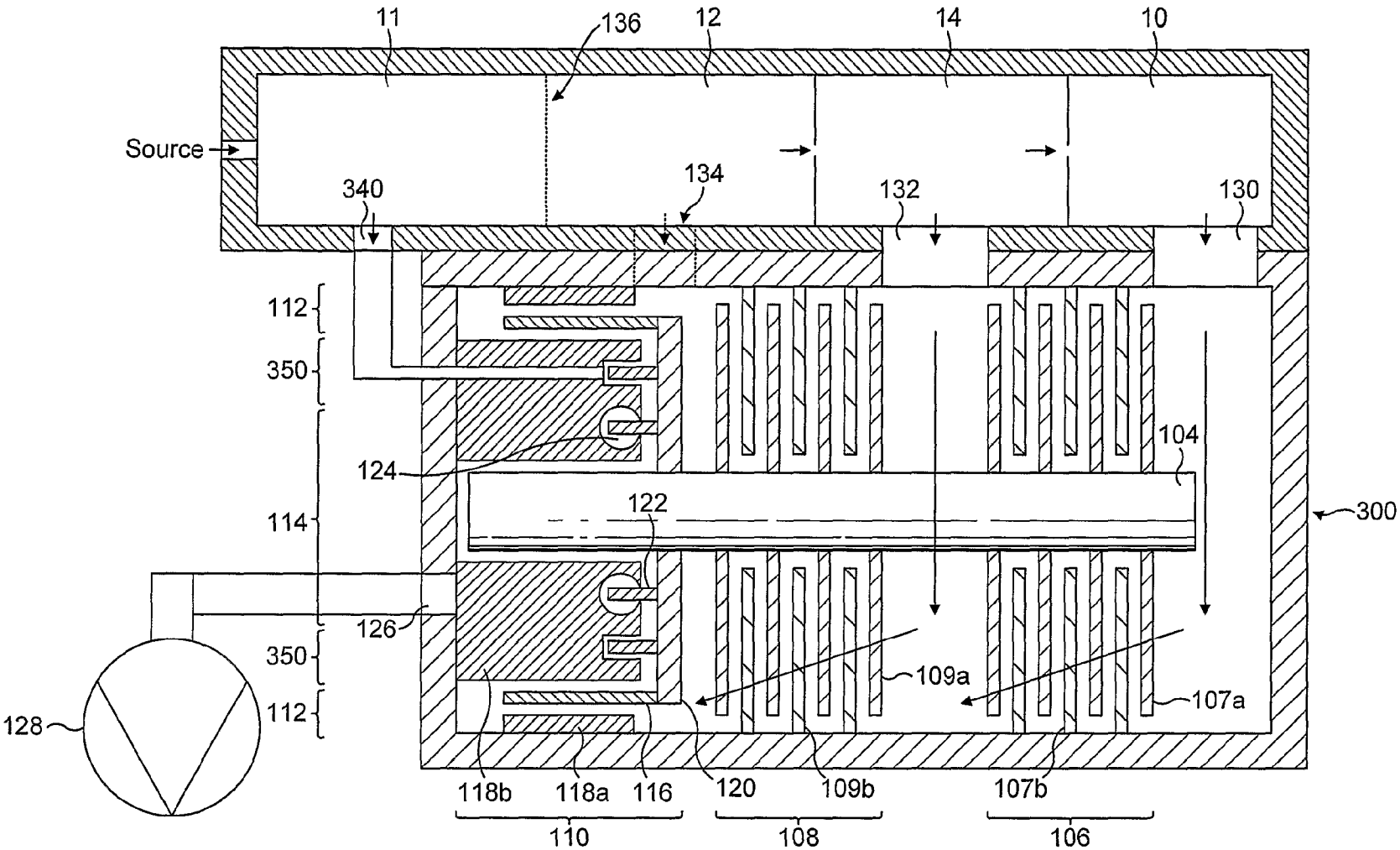
FIG. 5 is a simplified cross-section through a third embodiment of a multi port vacuum pump suitable for evacuating the differentially pumped mass spectrometer system of FIG. 1.

FIG. 5 provides a third embodiment of a vacuum pump 300 suitable for evacuating more than 99% of the total mass flow from a differentially pumped mass spectrometer system and is similar to the second embodiment, save that fluid passing through inlet 340 from the high pressure chamber 11 enters the pump 300, passes through the regenerative pumping mechanism 114 without passing through the molecular drag pumping mechanism 112, and exits the pump via pump outlet 126. Furthermore, as shown in FIG. 5, at least part of the regenerative pumping mechanism 114 may be replaced by a Gaede, or other molecular drag, mechanism 350. The extent to which the regenerative pumping mechanism 114 is replaced by a Gaede mechanism 350 depends on the required pumping performance of the vacuum pump 300. For example, the regenerative pumping mechanism 114 may be either wholly replaced or, as depicted, only partially replaced by a Gaede mechanism.

We claim:

1. A vacuum pump comprising a molecular drag pumping mechanism and, downstream therefrom, a regenerative pumping mechanism, wherein a rotor element of the molecular drag pumping mechanism surrounds rotor elements of the regenerative pumping mechanism and wherein a common stator forms part of the regenerative pumping mechanism and at least one pumping stage of the molecular drag pumping mechanism such that the rotor element of the molecular drag pumping mechanism surrounds the common stator.

2. The pump according to claim 1, wherein the molecular drag pumping mechanism comprises a multi-stage Holweck pumping mechanism.

3. The pump according to claim 2, comprising an impeller mounted on a drive shaft of the pump, a rotor being integral with the impeller.

4. The pump according to claim 3, wherein the rotor comprises a disc substantially orthogonal to the drive shaft.

5. The pump according to claim 1, wherein the rotor elements of the regenerative pumping mechanism comprise a series of blades positioned in an annular array on one side of a rotor.

6. The pump according to claim 5, wherein the blades are integral with the rotor.

7. The pump according to claim 5, wherein the rotor element of the molecular drag pumping mechanism is mounted on said one side of the rotor.

8. The pump according to claim 5, wherein the regenerative pumping mechanism comprises at least two series of blades positioned in concentric annular arrays on said one said of the rotor.

9. The pump according to claim 1, further comprising a Gaede pumping mechanism, the rotor element of the molecular drag pumping mechanism surrounding the rotor elements of the Gaede pumping mechanism.

10. An impeller for a vacuum pump, the impeller comprising a rotor element of a molecular drag pumping mechanism and a plurality of rotor elements of a regenerative pumping mechanism, wherein the rotor element of the molecular drag pumping mechanism surrounds the rotor elements of the regenerative pumping mechanism and the rotor element of the molecular drag pumping mechanism is part of two stages of the molecular drag pumping mechanism such that the rotor element of the molecular drag pumping mechanism surrounds one of the stages of the molecular drag pumping mechanism.

11. The impeller according to claim 10, further comprising a rotor that is integrally machined with the impeller and to which the rotor element of the molecular drag pumping mechanism is mounted.

12. The impeller according to claim 11, wherein the rotor comprises a disc substantially orthogonal to the longitudinal axis of the impeller.

13. The impeller according to claim 10, wherein the rotor elements of the regenerative pumping mechanism comprise a series of blades positioned in an annular array on one side of a rotor.

14. The impeller according to claim 13, wherein the blades are integral with the rotor.

15. The impeller according to claim 13, wherein the rotor element of the molecular drag pumping mechanism is mounted on said one side of the rotor.

16. The impeller according to claim 13, wherein the regenerative pumping mechanism comprises at least two series of blades positioned in concentric annular arrays on said one said of the rotor.

17. An impeller for a vacuum pump, the impeller machined to form integrally thereon a rotor element of a turbomolecular pumping stage, a plurality of rotor elements of a regenerative pumping mechanism, and a rotor for receiving a rotor element of a molecular drag pumping mechanism wherein the plurality of rotor elements of the regenerative pumping mechanism are positioned on a first side of the rotor and the rotor receives the rotor element of the molecular drag pumping mechanism such that the rotor element of the molecular drag pumping mechanism extends from the first side of the rotor.

18. The impeller according to claim 17, wherein the rotor comprises a disc substantially orthogonal to the longitudinal axis of the impeller.

19. The impeller according to claim 17, wherein the rotor elements of the regenerative pumping mechanism comprise a series of blades positioned in an annular array on the first side of the rotor.

* * * * *